US012031294B2

(12) United States Patent
Bennett, Jr.

(10) Patent No.: US 12,031,294 B2
(45) Date of Patent: Jul. 9, 2024

(54) DITCH BLADE ASSEMBLY

(71) Applicant: Tom Bennett, Jr., Corsicana, TX (US)

(72) Inventor: Tom Bennett, Jr., Corsicana, TX (US)

( * ) Notice: Subject to any disclaimer, the term of this patent is extended or adjusted under 35 U.S.C. 154(b) by 414 days.

(21) Appl. No.: 17/388,953

(22) Filed: Jul. 29, 2021

(65) Prior Publication Data

US 2023/0030705 A1 Feb. 2, 2023

(51) Int. Cl.
*E02F 5/22* (2006.01)

(52) U.S. Cl.
CPC ..... *E02F 5/226* (2013.01)

(58) Field of Classification Search
CPC ..... E02F 5/226
See application file for complete search history.

(56) References Cited

U.S. PATENT DOCUMENTS 1,557,035 A * 10/1925 Dost ..... E02F 5/22 172/686
1,575,814 A * 3/1926 Burson ..... E02F 3/7627 172/784
RE19,846 E * 2/1936 Ronning et al. ..... E02F 9/26 172/430
2,648,919 A * 8/1953 Brown ..... E02F 3/7627 37/372
3,181,258 A * 5/1965 Duncan ..... E02F 3/783 172/71
3,460,350 A * 8/1969 Speiser et al. ..... E02F 5/102 172/352
3,471,953 A * 10/1969 Wyatt ..... E02D 3/032 172/159
3,543,522 A * 12/1970 Torti ..... E21D 9/06 405/283
4,539,765 A * 9/1985 Reece ..... E02F 5/223 172/393
4,802,293 A * 2/1989 Smith ..... E02F 5/223 37/274
5,943,798 A * 8/1999 McGuire et al. ..... E02D 17/13 37/468
8,449,217 B2 * 5/2013 DiPizio et al. ..... E02F 5/12 404/83
2011/0016756 A1 * 1/2011 Schmidt ..... E02F 9/2037 37/403

* cited by examiner

*Primary Examiner* — Tara Mayo
(74) *Attorney, Agent, or Firm* — Law Office of Jeff Williams PLLC; J. Oliver Williams

(57) ABSTRACT

A ditch blade assembly includes a frame coupling opposing blades oriented in a V-shape. The blades are configured to scrape the ground or surface matter to distribute that matter into a singular channel and/or smooth the surface of the ground. A roller is included to compact the loose dirt exiting the gap between the blades. One or more weights are included to increase the down pressure on the blades. The blade angle may be adjusted with both a manual and hydraulic operating assembly.

18 Claims, 6 Drawing Sheets

DITCH BLADE ASSEMBLY

BACKGROUND OF THE INVENTION

1. Field of the Invention

The present application relates to a tractor implement, and more particularly to a ditch blade for moving dirt.

2. Description of Related Art

Tractors are common and sometimes necessary equipment for modern farming and ranching. They are used to perform what was once a number of laborious tasks. They move dirt, carry feed, harvest food, dig holes, mow grass, and so much more. Various attachments have been developed over time to broaden the capabilities of tractors. These attachments are used either with a front loader or through a 3-pt hitch. The 3-pt hitch is located at the back of the tractor. Common implements for use here are a box blade, a grader blade, rakes, harrows and so forth.

The box blade and the grader are used primarily to move dirt. They are dragged behind the tractor and have a large single blade that scrapes the ground. This blade is typically perpendicular to the direction of travel of the tractor. Adjustment of the arms of the 3-pt hitch can work to reorient the blades. Despite this functionality through the hitch, these blades are limited in general to that of pushing dirt and scraping dirt. The implements themselves are typically stuck with a singular orientation relying on tractor adjustments to reorient themselves. Each fails to provide any compaction of loose dirt.

A simple example can illustrate some of the failings of current box blades and graders. A common occurrence on a farm or ranch is the digging of a trench. Dirt is located on one or both sides of the trench while work is performed below grade. When it comes time to fill the trench with the loose dirt a box blade or grader blade may be used. These are typically perpendicular to the tractor and trench. Dirt on the side of the trench is only caught by the edges of the box blade and not directed toward the trench. If the implement is reoriented with the 3-pt hitch, the tractor still needs to shift to one side of the trench when driving to allow the singular orientation to slide the loose dirt into the trench. A problem with this is that the tractor tires often get too close to the trench or fall into the trench preventing this approach. What often happens is that typical blade implements can't efficiently be used and an operator has to use different equipment or the front loader to push dirt from the side. This is time consuming and most operators don't necessarily have other equipment. Furthermore, after filling the trench, the operator has to subsequently compact the dirt. This usually involves driving on the trench with multiple passes of the tractor. More time and cost are incurred.

Although strides have been made, shortcomings remain. It is desired that an assembly be provided that is able to include a dual blade design wherein the blades are oriented to the center to funnel dirt into a central channel. The design could optionally compact the loose dirt simultaneously to make the process more efficient.

BRIEF SUMMARY OF THE INVENTION

It is an object of the present application to provide a dual blade assembly for mounting onto a tractor for the purpose of moving loose dirt. The assembly is configured to cover or fill a ditch/trench in one pass from loose dirt on either or both sides by passing a dual blade ditch blade assembly over the trench. The dual blades are oriented so as to direct the loose side dirt toward a central point. One pass with a tractor moves the dirt to the trench.

It is a further object of the present application that the assembly saves fuel, time, and labor involved with filling trenches. One or more wheel weights may be used to add weight. Other embodiments may permit a weight box. The present assembly is useful to minimize the necessary passes by the tractor to a single pass as opposed to a plurality of passes by conventional equipment.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
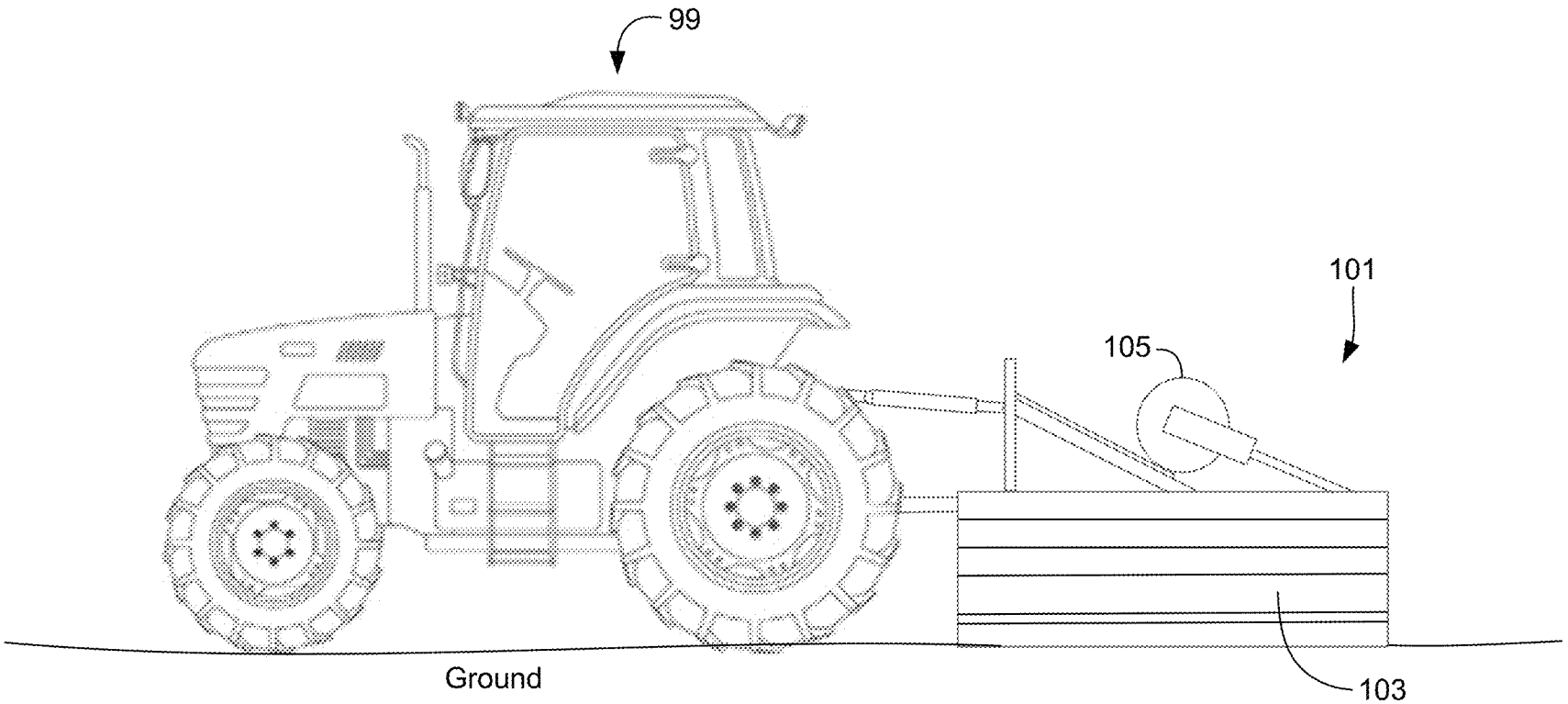
FIG. 1 is a side view of a tractor pulling a ditch blade assembly according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the ditch blade assembly of the present application is configured to utilize a dual blade set up wherein the blades are oriented toward one another at an angle to centrally direct the movement of dirt. The blades may be extended or retracted in some embodiments. Other embodiments may permit the adjustment of the angle between the blades. An optional roller is used to compact the loose dirt. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Figure 2:
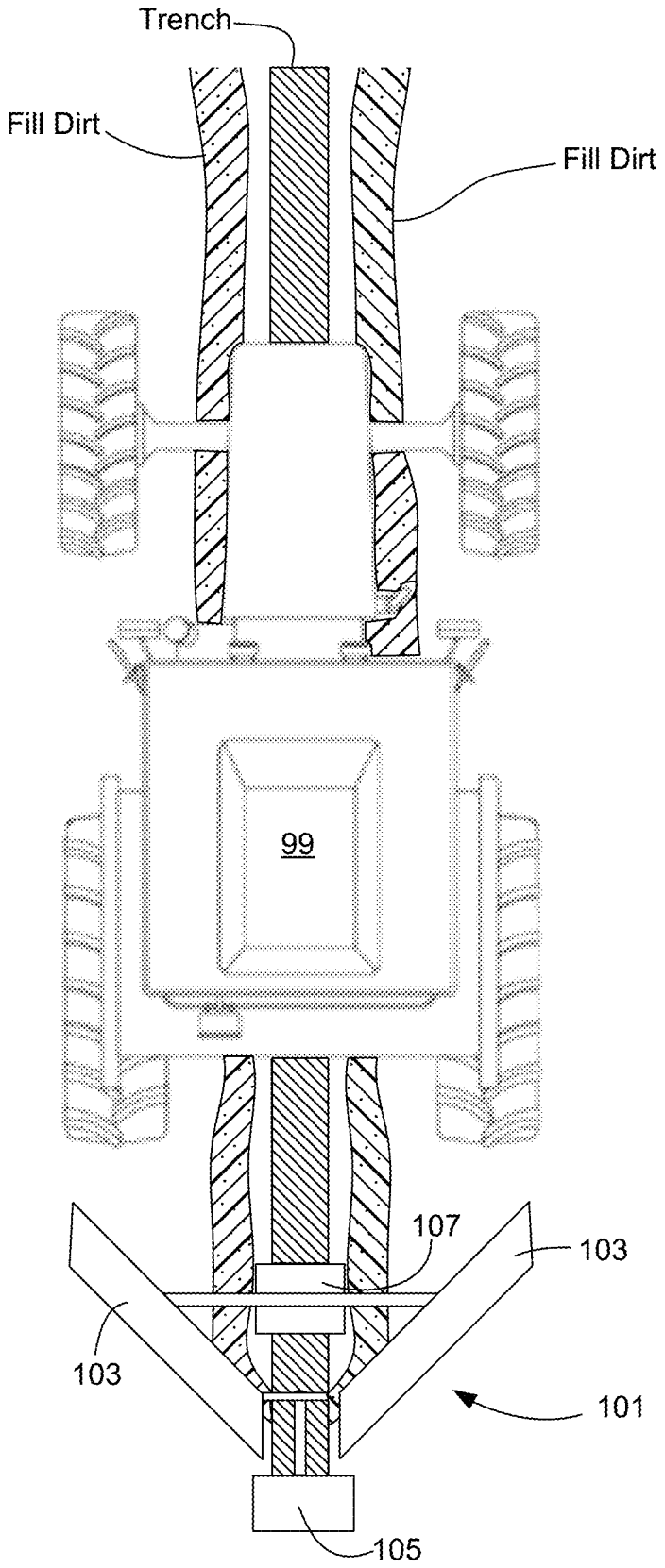
FIG. 2 is a top view of the tractor pulling the ditch blade assembly of FIG. 1.

Referring now to FIGS. 1-2 in the drawings, a ditch blade assembly 101 is illustrated. In these Figures, assembly 101 is illustrated in combination with a tractor 99. Assembly 101 is shown pulled behind tractor 99 in communication with the 3-pt hitch. Assembly 101 may be pulled behind the tractor or be coupled to a front of tractor 99 to push dirt with the blades as opposed to being pulled as shown.

Assembly 101 includes a plurality of blades 103 set at a predetermined angle relative to one another (i.e. V-shaped) wherein a forward end of the blades are spaced further apart than the aft end of the blades. A roller 105 is optionally included to compress loose dirt that is channeled between the aft ends of blades 103. FIG. 2 provides a more clear view of this wherein roller 105 is in the lowered position. A weight box 107 is also shown in FIG. 2 and is configured to provide extra weight to the assembly in accomplishing its task.

The operation of assembly 101 is shown clearly in FIG. 2. The trench is shown centrally with fill dirt on both sides of it. The fill dirt is typically obtained through the creation of the trench. As tractor 99 straddles the trench, the opposing blades direct the loose dirt centrally into the trench. Although not shown in FIG. 3, a gate can be placed between aft ends of the blades to assist in directing the dirt below grade. Roller 105 is deployed in a second position wherein it is lowered to the ground and acts to compress the loose dirt in the trench. One pass by the tractor with assembly 101 is all that is needed to fill and compress the trench.

Figure 3:
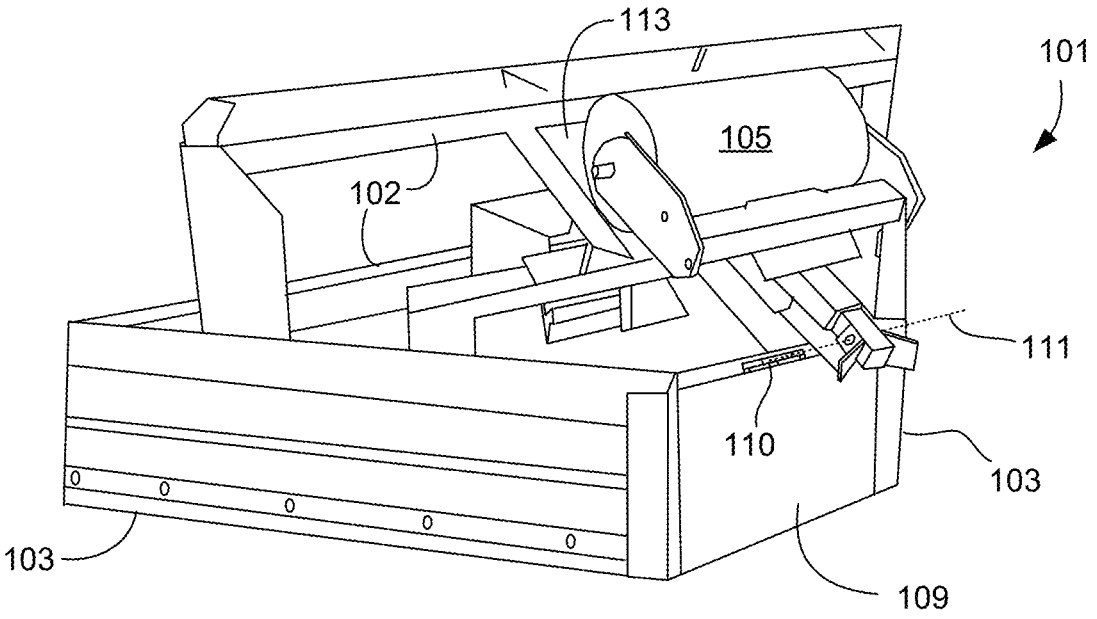
FIG. 3 is a rear perspective view of the ditch blade assembly of FIG. 1.

Referring now also to FIG. 3 in the drawings, a rear perspective view of assembly 101 is illustrated. Assembly 101 includes dual opposing blades 103, a frame 102, roller 105, a weight box 107, and a gate 109. As noted previously, blades 103 are set at an angle relative to one another such that aft ends of blades 103 are closer to one another and act to channel matter between the blades to a gap at the aft end of the blades.

A gate 109 may optionally be included in assembly 101 and is configured to selectively close the gap between the blades 103 at the aft end. Gate 109 may be fully withdrawn in a configuration such as one where gate 109 slides within a track. Other embodiments may permit gate 109 to pivot about a hinge 110 as seen in FIG. 3. Various methods are possible to allow for the temporary blocking and opening of the gap between the aft ends of the blades 103.

Roller 105 is configured to compress loose matter that exits the gap between the blades 103. Roller 105 may operate between a first position (retracted) and a second position (extended). As shown in FIG. 3, roller 105 is in the first position. Roller 105 may alternate between positions in any number of ways. In this embodiment, roller 105 is able to pivot about an axis 111. The weight of roller 105 keeps it in contact with the loose matter after leaving the blades 103. In other embodiments, roller 105 may be fully detached and reattached to go between positions. All different manners of positioning are conceivable. It is understood that assembly 101 may only optionally have or use roller 105.

Figure 4:
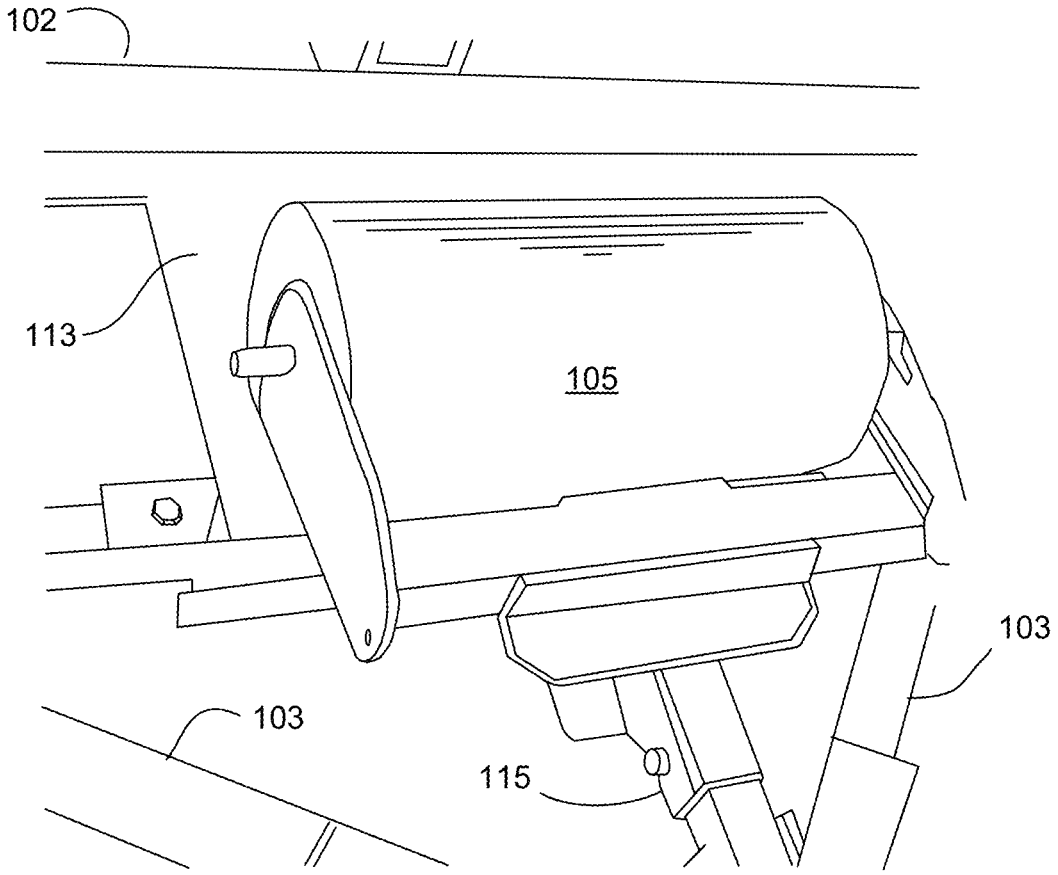
FIG. 4 is an enlarged upper view of the ditch blade assembly of FIG. 3.

Referring now also to FIG. 4, an enlarged perspective view of roller 105 is illustrated. Roller 105 is resting upon frame 102 which is used to support and secure the orientation of blades 103 and provide a coupling point with tractor 99. In operation, roller 105 coupled to frame 102. As seen in FIG. 4, a plate 113 may be used to support roller 105 when in the first position. Plate 113 is coupled to frame 102. Also of note is that roller 105 may include a coupler 115 that is configured to permit roller 105 to extend further from or closer to blades 103. It acts to adjust the distance of the arm of roller 105.

Figure 5:
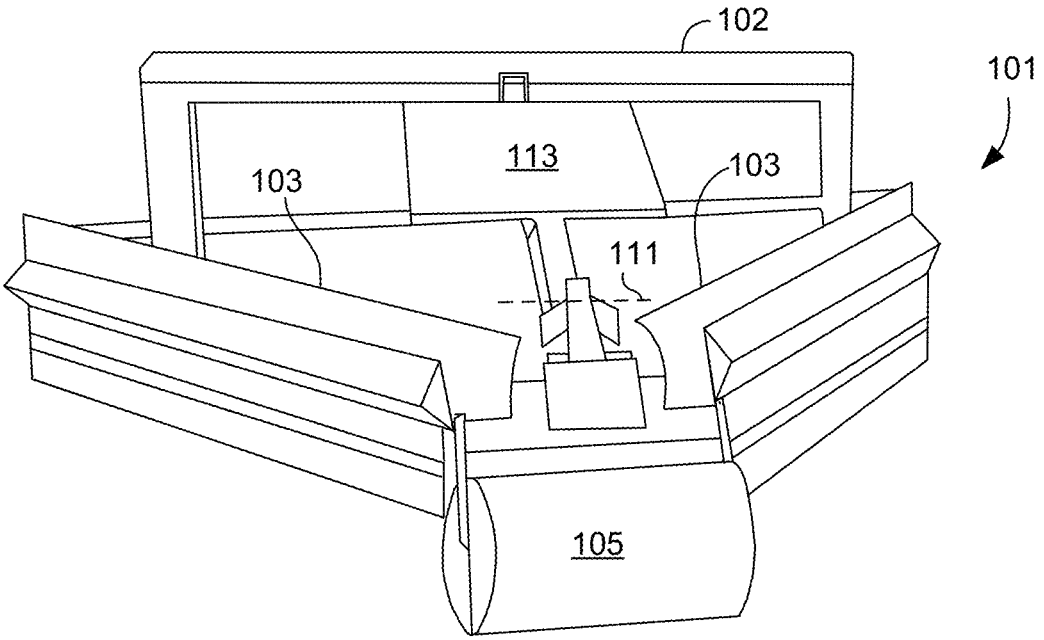
FIG. 5 is a rear view of the ditch blade assembly of FIG. 3.

Referring now also to FIG. 5 in the drawings, a rear view of assembly 101 is shown. In this view roller 105 is lowered into the second position. Plate 113 is visible, being supported by frame 102. Also of note is that blades 103 are contoured or curved such that the concave side faces the direction of travel. This allows the lower edge of blades 103 to curl towards the dirt and permits better soil distribution.

Figure 6:
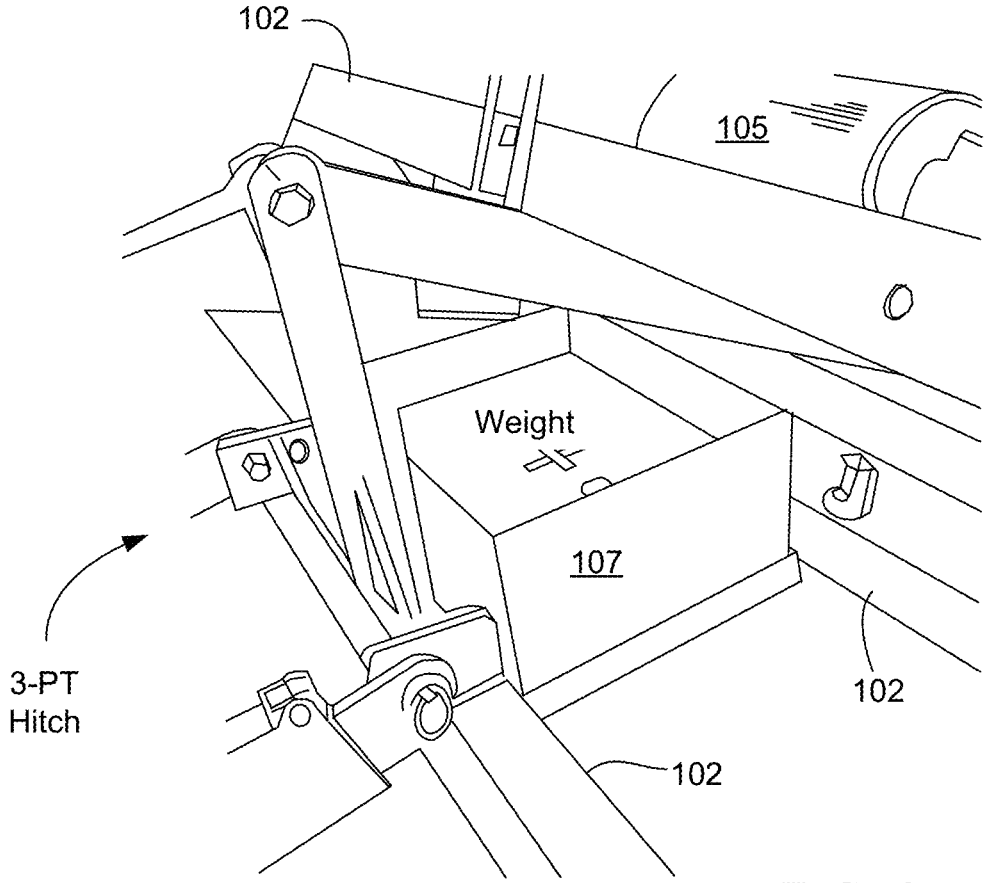
FIG. 6 is an upper side view of the ditch blade assembly of FIG. 3.

Referring now also to FIG. 6 in the drawings, a side perspective view within frame 102 is illustrated. In this view, weight box 107 is more clearly visible. Box 107 is coupled to frame 102 and is configured to hold one or more weights. The added weight helps blades 103 bite into the surface of matter better and assist in maintaining good soil distribution. Box 107 can receive or lose weights as needed by the user. Ideally box 107 is located centrally along the length of blades 107 to permit equal pressure along each blade length. Therefore box 107 is located within frame 102 frame rails below roller 105. When roller 105 is in the first position it is located centrally over blades 103 as well.

Figure 7:
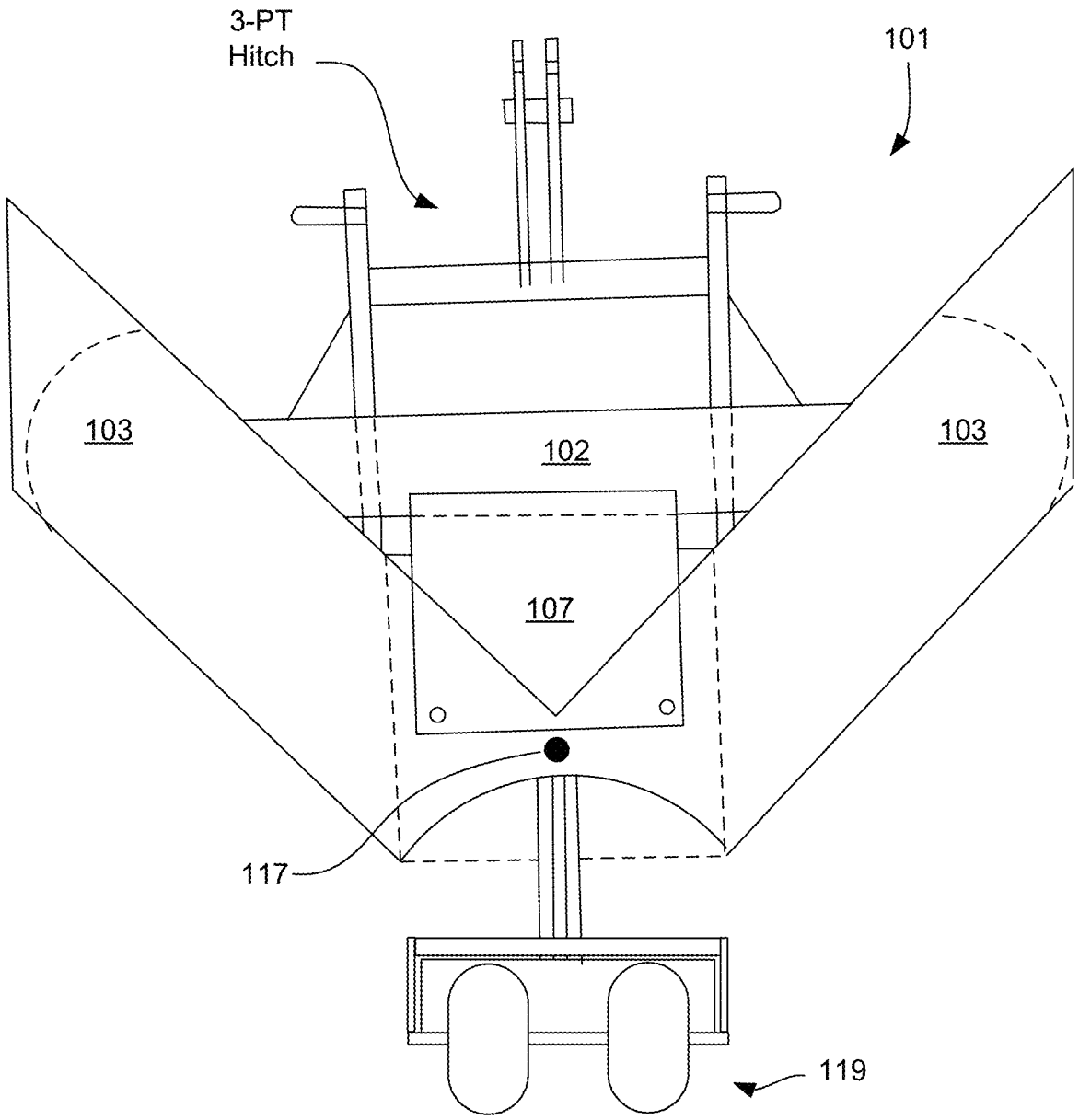
FIG. 7 is an exemplary bottom view of the ditch blade assembly of FIG. 1.

Referring now also to FIG. 7 in the drawings, an exemplary bottom view of assembly 101 is provided. In this configuration, the 3-pt hitch attachment is provided for viewing. The blade angle is set at approximately 45 degrees to one another. Although one embodiment shows blades 103 as being fixed at a set angle (i.e. 30 degrees, 45 degrees, 60 degrees . . . ), it is understood that assembly 101 may permit for the adjustment of blade angle. The blade angle is the angle between the blades. This may be adjusted by pivoting the blades at the aft ends about axis 117. Such action may result also in minimizing or maximizing the gap space.

Also of note in FIG. 7 is the optional inclusion of wheel assembly 119 in place of roller 105. Assembly 119 may include one or more wheels that can be configured to accept wheel weights. It should also be discussed that FIG. 7 shows the central location of box 107 between the aft and forward ends of blades 103. Additionally, the curved nature of blades 103 are also more visible. In this Figure, gate 109 is not shown.

Figure 8:
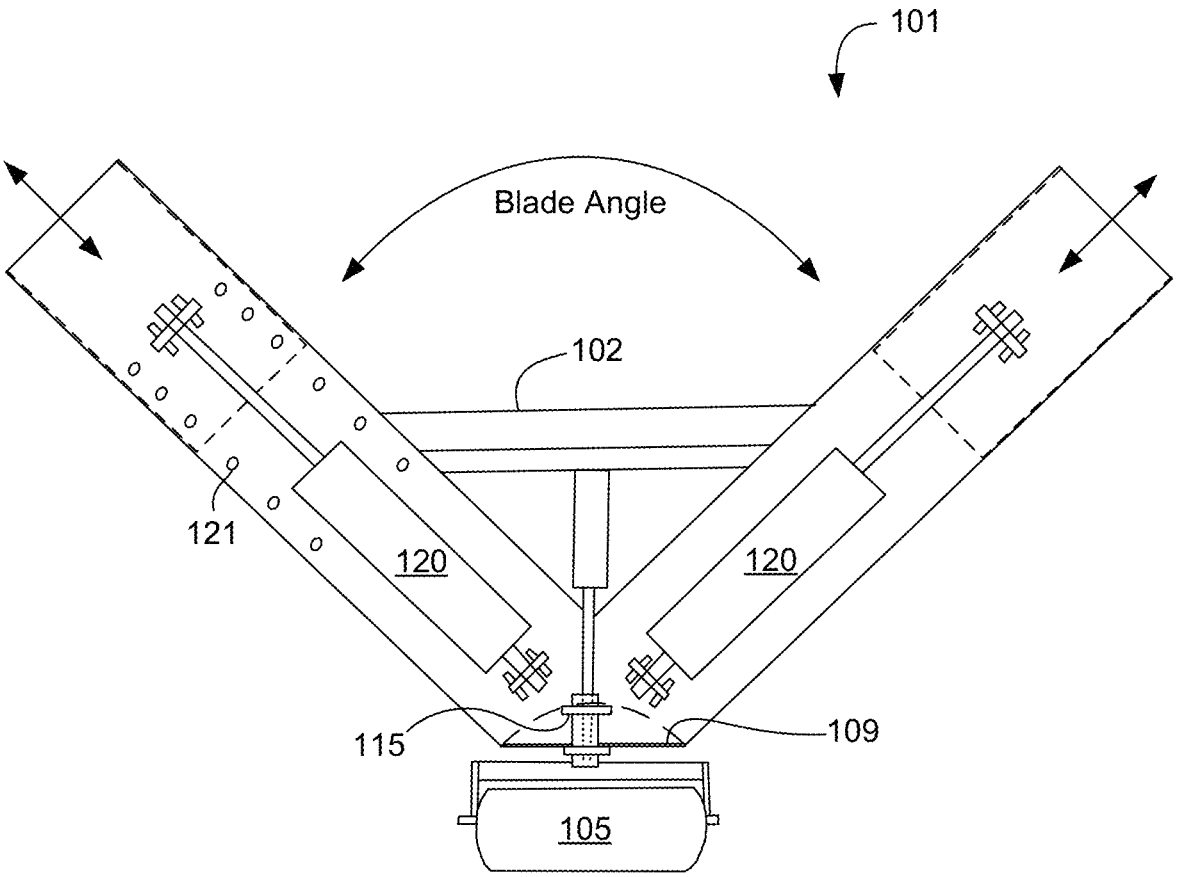
FIG. 8 is an exemplary top view of the ditch blade assembly of FIG. 1.

Referring now also to FIG. 8 in the drawings, an exemplary top view of assembly 101 is provided. FIG. 8 is useful to show additional optional features that can be added within assembly 101. As noted above, the blade angle is the angle between the blades. This is optionally adjustable. However, as seen, blades 103 may be extended. Assembly 101 may be a manually operated device wherein movement of the various parts happens through manual operation of the operator. In another embodiment, hydraulics may be used to operate the various parts as the tractor 99 has hydraulic capabilities. In this way, roller 105/wheel assembly 119 may be operated between positions. Coupler 115 may be operated to extend or retract the length of the arm via hydraulics. Additionally, one or more actuators 120 may be used in communication with blades 103 to either lengthen blades 103 and/or adjust the blade angle.

Each blade 103 may include a secondary blade that slides along a front face of its parent blade. This may be located anywhere along the face of the parent blade 103 to lengthen the overall blade or minimize it. This works well with a hydraulic assembly. In a manual assembly, blades 103 may include apertures 121 to permit for the manual translation or attachment of a secondary blade. Aperture 121 may also be used to fasten on a strait blade from another box blade implement as well.

A number of advantages of assembly 101 over the prior art have been described, including at least the following: 1) the use of opposing blades acts to fill a trench in a singular pass; 2) better performance in grading and moving matter; 3) replaces the need of a box blade as the blade angle may adjust; and 4) may be pulled with a 3-PT hitch or pushed with the front of the tractor.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A ditch blade assembly, comprising:

a first blade;

a second blade, the first blade and the second blade oriented at an angle relative to one another;

a frame configured to secure the first blade and the second blade in position; and a roller coupled to the frame between the first and second blades, the roller configured to operate between a first position and a second position;

wherein the first blade and the second blade scrape dirt and simultaneously direct loose dirt to a singular channel.

2. The assembly of claim 1, wherein the channel is centrally located between the first blade and the second blade.

3. The assembly of claim 1, wherein a forward end of the first and second blades is spaced farther apart than an aft end of the first and second blades.

4. The assembly of claim 1, wherein the angle of orientation of the first and second blades is fixed.

5. The assembly of claim 1, wherein the angle or orientation of the first and second blades is adjustable.

6. The assembly of claim 1, wherein at least one of the first blade and second blade can be adjusted in length.

7. The assembly of claim 1, further comprising:

a weight box coupled to the frame, the weight box configured to accept additional weight to increase the force of the first blade and the second blade on the dirt.

8. The assembly of claim 1, wherein the first position is elevated above at least one blade.

9. The assembly of claim 1, wherein the second position is lowered behind at least one blade, the roller configured to compress loose dirt exiting the blades.

10. The assembly of claim 1, wherein the first blade and the second blade is curved forward so permit better soil distribution.

11. The assembly of claim 1, wherein the blades operate off of hydraulic pressure.

12. The assembly of claim 1, wherein the blades operate manually.

13. The assembly of claim 1, further comprising:

a gate extending between the aft ends of the first and second blades so as to span a gap therebetween.

14. A method of filling a trench, comprising:

obtaining a ditch blade assembly according to claim 1;

orienting the first blade relative to the second blade;

directing loose dirt centrally between the first and the second blade.

15. The method of claim 14, further comprising:

compacting the loose dirt with a roller.

16. The method of claim 14, further comprising:

adjusting the length of the first blade.

17. The method of claim 14, further comprising:

changing the angle between the blades.

18. A ditch blade assembly, comprising:

a first blade;

a second blade, the first blade and the second blade oriented at an angle relative to one another;

a frame configured to secure the first blade and the second blade in position; and a wheel assembly coupled to the frame behind the first and second blades, the wheel assembly includes one or more weights;

wherein the first blade and the second blade scrape dirt and simultaneously direct loose dirt to a singular channel.

* * * * *